US005203426A

United States Patent [19]

Sydnor

[11] Patent Number: 5,203,426

[45] Date of Patent: Apr. 20, 1993

[54] PORTABLE WINDOW PERCH ASSEMBLY

[76] Inventor: Eugene E. Sydnor, 3508 Legere Ct., Woodbridge, Va.

[21] Appl. No.: 833,663

[22] Filed: Feb. 11, 1992

[51] Int. Cl.[5] ..... A47L 3/00

[52] U.S. Cl. ..... 182/57; 182/55

[58] Field of Search ..... 182/53-62

[56] References Cited

U.S. PATENT DOCUMENTS

| | | | |
|---|---|---|---|
| 370,739 | 9/1887 | Hysan | 182/57 |
| 863,877 | 8/1907 | Regondi . | |
| 2,194,978 | 3/1940 | Ireland . | |
| 2,736,615 | 2/1956 | Gormley . | |
| 4,320,816 | 3/1982 | Callahan et al. . | |
| 4,367,809 | 1/1983 | Eikelmann | 182/59 X |

FOREIGN PATENT DOCUMENTS

| | | | |
|---|---|---|---|
| 255735 | 7/1967 | Austria | 182/55 |
| 128779 | 6/1932 | Fed. Rep. of Germany | 182/58 |
| 744950 | 4/1933 | France | 182/58 |

*Primary Examiner*—Alvin C. Chin-Shue
*Attorney, Agent, or Firm*—Richard C. Litman

[57] ABSTRACT

An improved portable window perch is easily assembled to allow a user to stand on a perch outside the window of a building structure. The perch is supported by a scaffold placed up against the inside wall surrounding a window. The scaffold has two vertical bars displaced from one another and which can be folded in half through the use of hinges on each of the two vertical bars. The vertical bars are displaced from one another with a cross member between them. Also, at the top of the two vertical bars is an upper horizontal bar, while at the bottom there is a lower horizontal bar. The two horizontal bars have padding thereon so as to prevent damage to the wall. The perch has two arms extended through the window, connected to a platform at one end, suspended outside the window, and a clamp at the other, connected to the cross member with the scaffold erected up against the inside wall, so that the perch is securely and safely supported outside the window.

9 Claims, 4 Drawing Sheets 11
13
15
3
17
10
12
31
19
14
29
2
26
16
18
22
32
28
27
21
33
30
8
20
5
25
24
9
23

PORTABLE WINDOW PERCH ASSEMBLY

BACKGROUND OF THE INVENTION

The outside trim of windows as well as the supplemental dressing associated therewith require periodic attention, such as washing, painting, repairing, etc. Various scaffolds and perches have been devised to facilitate access to the outside surrounding area of a window that is not accessible from ground level.

U.S. Pat. No. 863,877 issued Aug. 20, 1907 to Giuseppe Regondi discloses a window perch in which a pair of vertical bars are anchored to the inside window sill and have a cross member attached thereto. The perch platform is stabilized by a pair of braces, each attached at one end to one of the vertical bars and at the other end to the platform being supported.

U.S. Pat. No. 2,194,978 issued Mar. 26, 1940 to Newton Ireland discloses a window cleaning scaffold which is anchored by clamps positioned around the inside window sill and stabilized by cushioning members that contact the outside wall and the outside section of the window sill.

U.S. Pat. No. 2,736,615 issued Feb. 28, 1956 to Patrick Gormley relates to a window scaffold that is held in place by an anchoring frame placed on the inside and having two vertical bars with a cross member attached thereto. The perch is attached to this cross member through the use of turnbuckles and the outside wall stabilizes the perch.

U.S. Pat. No. 4,320,816 issued Mar. 23, 1982 to Phyllis M. Callahan et al. discloses a window perch that has a clamping arrangement for fastening the perch between the inside and outside wall just below the window.

None of the prior art of record discloses a window perch which avoids contact with the outside wall and any part of the window.

SUMMARY OF THE INVENTION

Accordingly, it is one object of the present invention to provide a scaffold to support and stabilize a window perch, wherein the scaffold does not contact the outside wall or any part of the window.

It is another object of the present invention to provide a foldable, portable, and easily erected window perch and scaffold which can be moved and used by one person.

It is still another object of the present invention to provide a window perch and scaffold, wherein padding is provided on the cross members of the scaffold to prevent damage to the inside wall.

These and other objects of the present invention will become apparent upon further review of the following drawings and specification.

DETAILED DESCRIPTION OF THE PREFERRED EMBODIMENTS

Figure 1:
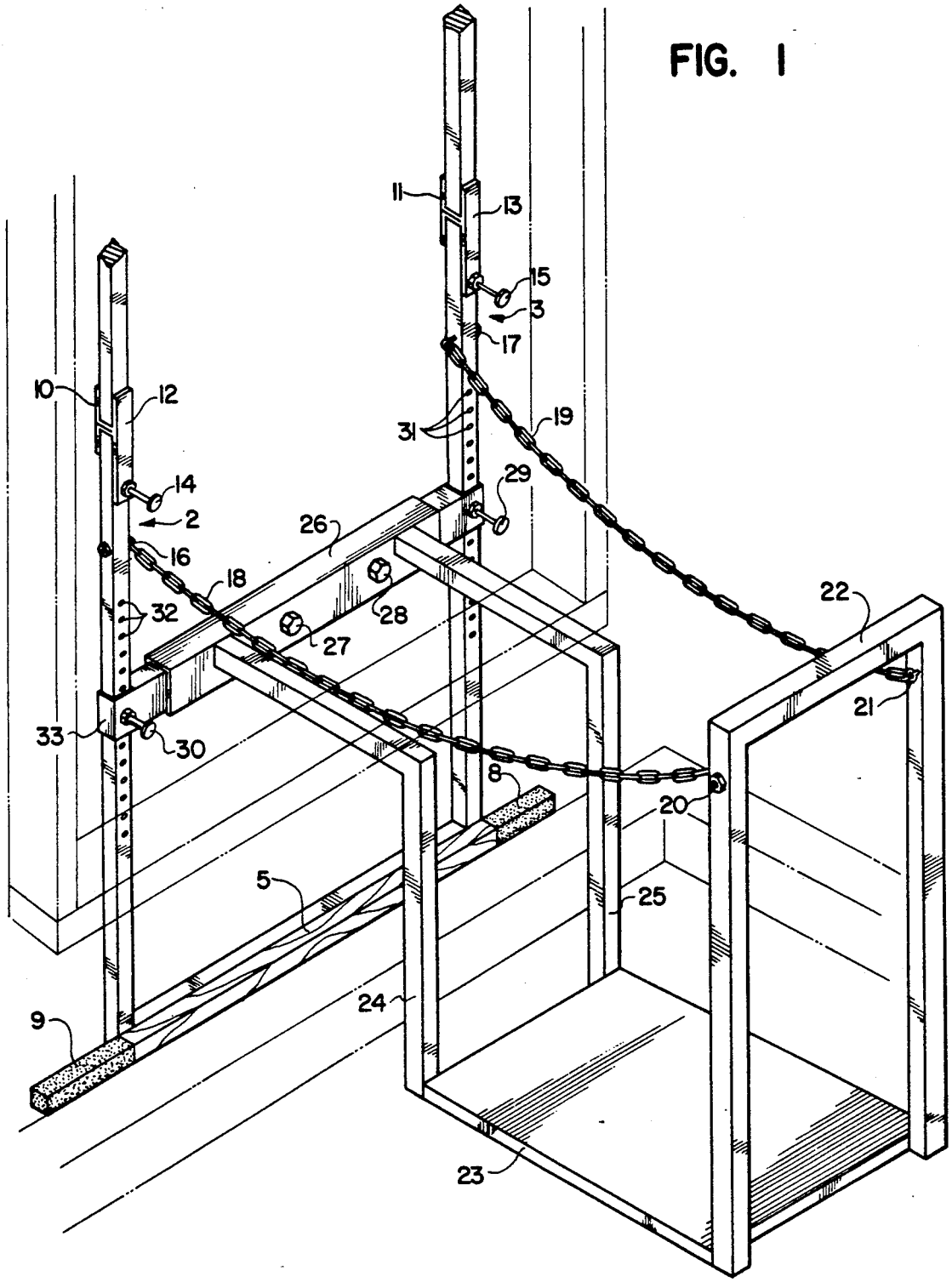
FIG. 1 shows a side perspective of a first embodiment of the present invention.

In FIG. 1, the window perch assembly 1 of the present invention is shown. In the preferred embodiment, the window perch assembly 1 is made from aluminum or an aluminum alloy. As shown, a platform 23 is provided for allowing a user to stand outside the window. The platform 23 has a back portion 22 extending upward from its two back corners. Two safety chains extend along both ends of the perch. A chain 18 is attached at one end to the vertical bar 2 by a fastener 16, which is a removably adjustable fastening assembly such as an eye hook, nut, and washer, for example. The other end of chain 18 is attached to one end of the back portion 22 by a fastener 20 having a similar fastener 16. Likewise, chain 19 is attached at one end to vertical bar 3 by a similar fastener assembly 17 and at the other end to the other end of the back portion 22 by another, similar fastener assembly 17. The chains 18 and 19 provide greater safety to a user on the perch.

The perch includes the platform 23, the back portion 22, two arms 24 and 25, and a clamp 26. Arm 24 has a first portion extending upward from one corner of the front of the platform 23, and a second portion extending in a horizontal direction away from the platform 23 which attaches to a horizontal cross member 33 via clamp 26, in a manner to be described below. Arm 25, attached to the opposite front corner of the platform 23, also has a first portion extending upward, and a second portion extending horizontally to attach to the cross member 33, also via clamp 26.

The arms 24 and 25 are attached to the cross member 33 by the use of a clamp 26 to which the arms 24 and 25 are permanently attached, as by welding, as shown in FIG. 1. The clamp 26 is then screwed to the cross member 33 through the use of fasteners 27 and 28, each consisting of a nut, washer, and bolt arrangement. The cross member 33 can be adjusted to various heights along the scaffold arrangement through the use of hand screws 29 and 30, which are inserted into a selected one of the screw holes 31 and 32, respectively.

Figure 2:
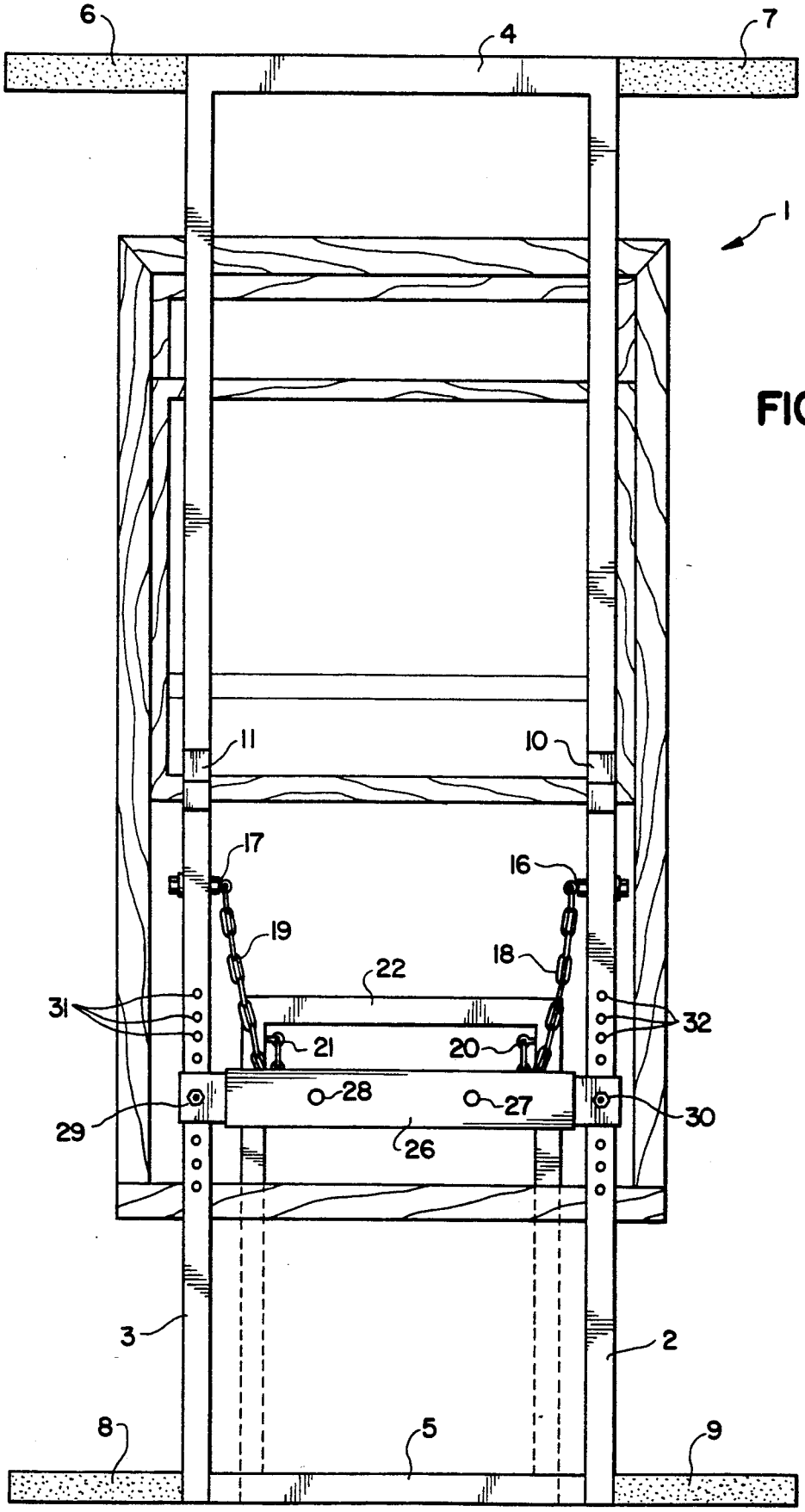
FIG. 2 shows a back environmental view of the first embodiment of the present invention.
Figure 3:
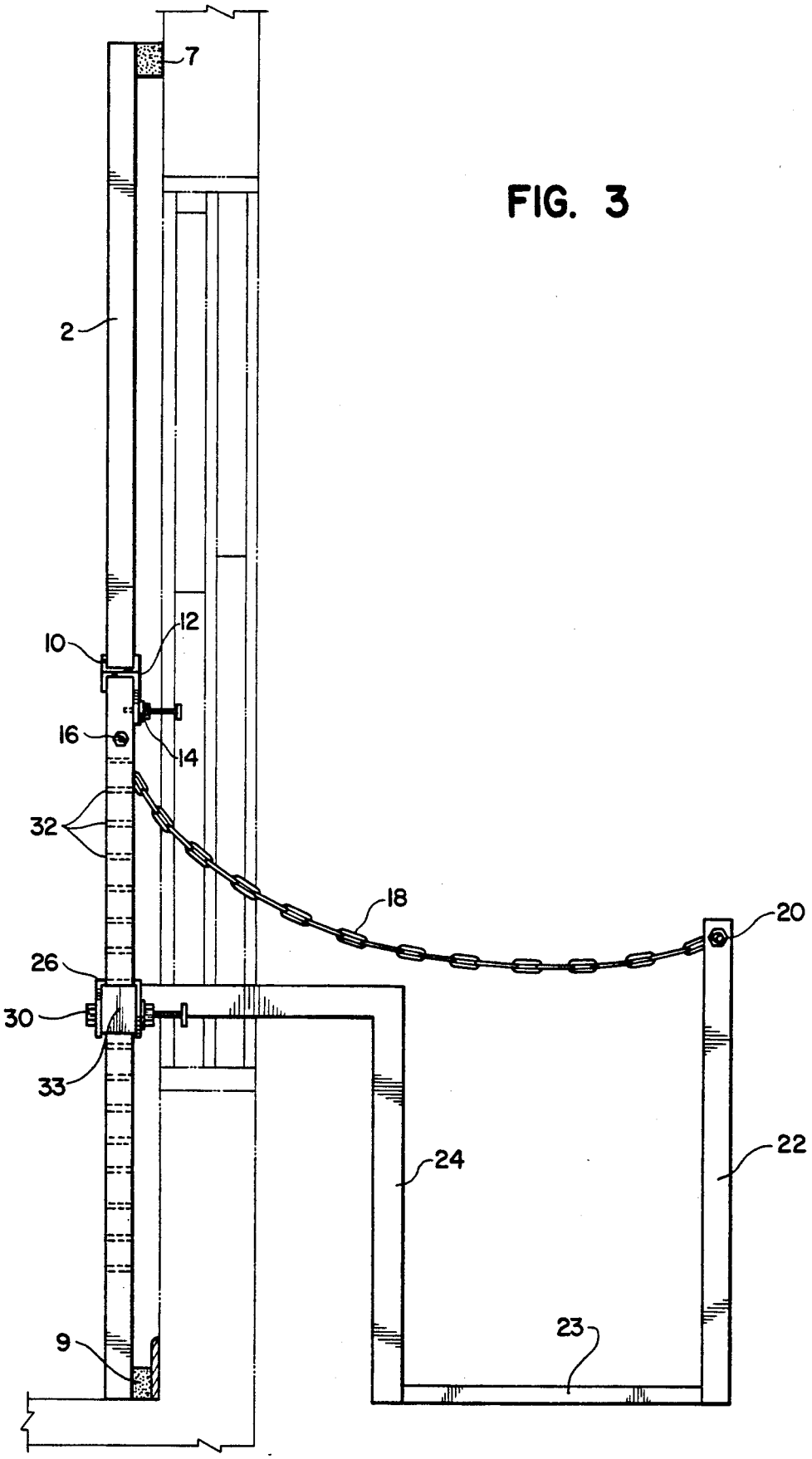
FIG. 3 shows a side environmental view of the first embodiment of the present invention.

As shown in FIG. 2, the scaffold has two vertical bars 2 and 3 separated by a predetermined horizontal distance. Each of the vertical bars 2 and 3 is the same length or heighth and extends from the floor of the building structure below the window to a point above the window. At the top of the scaffold is an upper horizontal bar 4 which contacts the inside wall of the building structure above the window. At the bottom of the scaffold is a lower horizontal bar 5 which contacts the floor and lower portion of the inside wall of the building structure below the window. Between the upper and lower horizontal bars is the cross member 33. The cross member 33 is adjusted to a desired height, as discussed above, so that the perch does not come in contact with any part of the window, particularly the bottom window sill. Furthermore, the upper horizontal bar 4 has padding 6 at one end thereof and padding 7 at the other end. Likewise, lower horizontal bar 5 has padding 8 and padding 9 located one at each end thereof. The padding on the horizontal bars 4 and 5 are the portions thereon which come in contact with the wall to prevent damage thereto. As shown in FIG. 3, the horizontal bars 4 and 5 also act as spacers to displace the vertical bars 2 and 3 from the wall so that the vertical bars to not contact any part of the window protruding into the building structure from the wall, such as the window frame or window sill.

To enable the window perch assembly 1 to be easily transported to the location of the window and then erected, the perch can be selectively attached to or removed from the cross member 33 as discussed above. Further, the scaffold can be folded in half. This is accomplished through the use of two hinges 10 and 11, wherein hinge 10 interrupts the vertical bar 2 and the hinge 11 interrupts the vertical bar 3 (see FIGS. 1 and 2). As shown in FIG. 2, the hinges 10 and 11 allow the upper part of the scaffold to fold into the room. As shown in FIG. 1, a bar 12 is rigidly and securely connected to the upper half of the vertical arm 2 through any conventional means, e.g. welding. The lower half of the vertical arm 2 is connected to the bar 12 through the use of a hand screw 14 screwed into a hole positioned behind the screw (see FIG. 3). Likewise, the bar 13 and hand screw 15 are structured and function in the same way to lock the upper and lower halves of vertical arm 3 in a vertical position.

Figure 4:
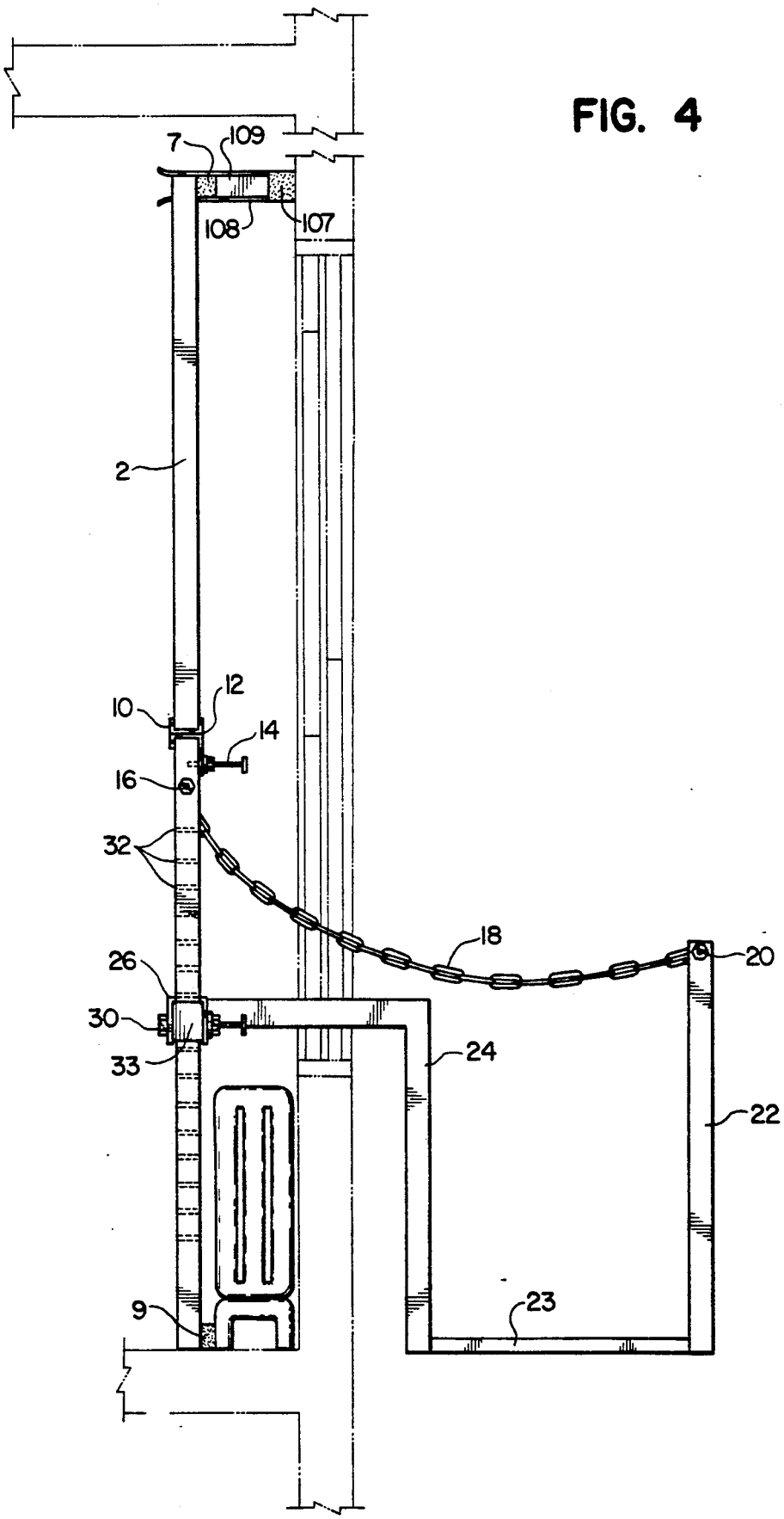
FIG. 4 shows a side environmental view of a second embodiment of the present invention.

As shown in FIG. 4, an attachment at the top of the scaffold may be provided in the event that there is an object below the window which could not be easily moved, such as a heater, e.g., a radiator, as shown. The attachment has a horizontal bar with padding, such as padding 107, in the same manner as horizontal bars 4 and 5. A clamp 108 with a spacer 109 located therein, is fastened to the upper horizontal bar 4 by fitting the clamp 108 thereon between the vertical bars 2 and 3. The spacer 109 then comes in contact with the horizontal bar 4 between the vertical bars 2 and 3. The clamp 108 prevents the attachment from falling off the horizontal bar 4. Thus, the scaffold can be displaced at various distances from the wall by using different length spacers 109. The bottom of the scaffold contacts the radiator and floor in the same manner as previously described wall.

While the preferred embodiments have been presented above, the scope of invention is not limited thereto, but is intended to encompass all of the embodiments of the following claims.

I claim:

1. An improved portable window perch assembly usable with a window which may be opened to allow access from the inside of a building structure to the outside of said building structure comprising:

a first vertical bar having a predetermined vertical length;

a first hinge located in the middle of said first vertical bar for selectively collapsing and extending said first vertical bar about its length;

a second vertical bar having a vertical length equivalent to said predetermined vertical length, said second vertical bar being located a predetermined horizontal distance from said first vertical bar;

a second hinge located in the middle of said second vertical bar for selectively collapsing and extending said second vertical bar about its length;

an upper horizontal bar extending from the top of said first vertical bar to the top of said second vertical bar;

a lower horizontal bar extending from the bottom of said first vertical bar to the bottom of said second vertical bar;

a horizontal cross member;

means for attaching said horizontal cross member at one end thereof to said first vertical bar and at the other end thereof to said second vertical bar; and a perch for allowing a user to stand thereon, and including means for attaching said perch to said horizontal cross member, wherein, during operation of said window perch assembly, both said first and second vertical bars are extended and said lower horizontal bar contacts the floor and lower portion of the inside wall of said building structure below said window while said upper horizontal bar contacts the inside wall of said building structure above said window, in such a way that said first and second vertical bars are displaced from said inside wall thereby preventing contact between said perch assembly and said window.

2. The improved portable window perch assembly of claim 1, further comprising:

a first pad located on one end of said upper horizontal bar;

a second pad located on the other end of said upper horizontal bar;

a third pad located on one end of said lower horizontal bar;

a fourth pad located on the other end of said lower horizontal bar, wherein the first, second, third, and fourth pads contact the inside wall to prevent damage thereto.

3. The improved portable window perch assembly as claimed in claim 2, wherein said perch further comprises;

a platform for the user to stand thereon, said platform having two front corners in the front end thereof and two back corners in the back end thereof;

a back portion extending upward from both corners of the back end of said platform, wherein one end of said back portion is directly above one back corner and the other end of said back portion is directly above the other back corner of the platform;

a first arm having a first portion thereof extending vertically upward from one corner of the front end of said platform and a second portion thereof extending in a horizontal direction away from said platform to attach to said horizontal cross member; and a second arm having a first portion thereof extending vertically upward from another corner of the front end of said platform opposite said one corner and a second portion thereof extending in a horizontal direction away from said platform to attach to said horizontal cross member, wherein, during operation of said window perch assembly, said first and second arms extend through the window from said horizontal cross member.

4. The improved portable window perch assembly as claimed in claim 3, further comprising:

a first lock for locking said first hinge when said first vertical bar is extended; and a second lock for locking said second hinge when said second vertical bar is extended.

5. The improved portable window perch assembly as claimed in claim 4, further comprising:

a first safety chain extending from said first vertical bar to one end of said back portion; and a second safety chain extending from said second vertical bar to the other end of said back portion.

6. The improved portable window perch assembly as claimed in claim 5, further comprising:

first adjusting means for adjusting the vertical position on said first vertical bar on which said one end of said horizontal cross member is attached; and second adjusting means for adjusting the vertical position on said second vertical bar on which said other end of said horizontal cross member is attached, wherein, during operation of said window perch assembly, the height of said horizontal cross member above the floor may be adjusted via said first and second adjusting means so that said first and second arms are located above the bottom window sill so as not to touch the bottom window sill.

7. The improved portable window perch assembly as claimed in claim 6, wherein said perch further comprises:

a clamp to which said first and second arms are attached; and means for selectively attaching and removing said clamp to said horizontal cross member.

8. The improved portable window perch assembly as claimed in claim 7, further comprising an extension piece attachable to said upper horizontal bar, for increasing the distance said first and second vertical bars are displaced from said inside wall, wherein, during the operation of said window perch assembly in an environment where an object is located below said window which is not easily moved, said extension piece is attached to said upper horizontal bar and engaged with the inside wall of said building structure above said window while said lower horizontal bar is engaged with the floor and said object located below said window such that both said first and second vertical bars remain in a vertical position.

9. The improved portable window perch assembly as claimed in claim 1, wherein said portable window perch assembly is made of aluminum.

* * * * *